US008412060B2

(12) United States Patent
Watanabe

(10) Patent No.: US 8,412,060 B2
(45) Date of Patent: Apr. 2, 2013

(54) IMAGE FORMING APPARATUS AND METHOD FOR PERFORMING IMAGE FORMING USING AN ELECTROPHOTOGRAPHIC PROCESS

(75) Inventor: Masaru Watanabe, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 317 days.

(21) Appl. No.: 13/013,432

(22) Filed: Jan. 25, 2011

(65) Prior Publication Data

US 2011/0182598 A1 Jul. 28, 2011

(30) Foreign Application Priority Data

Jan. 27, 2010 (JP) ..... 2010-016040

(51) Int. Cl.
*G03G 15/00* (2006.01)

(52) U.S. Cl. ..... 399/43

(58) Field of Classification Search ..... 399/43, 399/46, 38

See application file for complete search history.

(56) References Cited

U.S. PATENT DOCUMENTS 6,104,891 A 8/2000 Maebashi et al.

FOREIGN PATENT DOCUMENTS

| | | | |
|---|---|---|---|
| JP | 11-295956 | | 10/1999 |
| JP | 2001328237 A | * | 11/2001 |
| JP | 2006-330686 | | 12/2006 |
| JP | 2009210786 | | 9/2009 |

* cited by examiner

*Primary Examiner* — Quana M Grainger
(74) *Attorney, Agent, or Firm* — K&L Gates LLP

(57) ABSTRACT

An image forming apparatus using an electrophotographic process includes an image forming unit, a storage unit, and a control unit. The image forming unit performs monochrome printing and color printing. The storage unit stores print ratio data that relates to printing in the image forming unit is measured over time. The control unit separately performs correction of monochrome toner density and color toner density based on a predetermined first condition. If the first condition in the monochrome printing is met, the control unit performs correction of the monochrome toner density if a predetermined second condition concerning an amount of variation in the print ratio identified from the print ratio data is also met.

12 Claims, 5 Drawing Sheets

IMAGE FORMING APPARATUS AND METHOD FOR PERFORMING IMAGE FORMING USING AN ELECTROPHOTOGRAPHIC PROCESS

INCORPORATION BY REFERENCE

This application is based upon and claims the benefit of priority from the corresponding Japanese Patent application No. 2010-16040, filed Jan. 27, 2010, the entire contents of which is incorporated herein by reference.

BACKGROUND

The present invention relates to image forming apparatuses and methods for performing image forming using an electrophotographic process.

Generally, in image forming apparatuses and methods for performing image forming using an electrophotographic process, toner is transferred on a toner carrier to form a patch image (reference image) and the amount or position of the toner on the patch image is detected to perform density or color misregistration correction. For example, in a mode (calibration mode) for appropriately setting the density of an image of each color in full-color image forming apparatuses, image forming units for cyan, magenta, yellow, and black are used to form a correction patch image of each color on transfer belts. The formed correction patch image is detected to perform density or color misregistration correction.

The density of black toner mainly relates to saturation and brightness, in the case of monochrome printing using only the black image forming unit, and the density of color toner mainly relates to hue in the case of color printing using cyan, magenta, and yellow image forming units. In addition, the saturation and brightness that are varied do not lower the impression of the image, compared with the situation where the hue is varied. Accordingly, it is not necessary to frequently correct the monochrome (black) toner density, compared with correction of the color (cyan, magenta, and yellow) toner density.

Since calibration of the respective colors is generally simultaneously performed based on a single correction condition relating to, for example, the number of prints or the printing time in such density correction in the color image forming apparatuses, correction of the monochrome toner density is performed too frequently.

In order to resolve the above problems, for example, in an image forming apparatus, the correction condition of the monochrome toner density is separately set from that of the color toner density based on the number of prints. And the interval of the number of prints corresponding to the time when the monochrome toner density is corrected is set to a value that is more than the interval of the number of prints corresponding to the time when the color toner density is corrected, to reduce the number of times when the monochrome toner density is corrected.

However, for example, if a large volume of monochrome printing is continuously performed even if the monochrome correction condition is set so that it is different from the color correction condition, the color toner density is simultaneously corrected with the correction of the monochrome toner density even without the color printing. If such a situation is repeated, the color toner in the developer is exposed to excessive mechanical stress accelerating deterioration of the toner. In addition, the amount of electrostatic charge of the toner may increase causing a condition wherein optimal toner density is not achieved in the color printing. Furthermore, the density correction is generally set so as to be forcedly performed by interrupting the printing process during continuous printing. Accordingly, if the correction condition is met during continuous printing, printing will be interrupted making the user wait for completion of the density correction, thus decreasing printing speed.

In order to resolve the above problems, in another image forming apparatus, the time when the monochrome toner density is corrected and the time when the color toner density is corrected are appropriately set. Control means for separately performing correction of the monochrome toner density and of the color toner density is provided to reduce the number of times when unnecessary correction of the color toner density is performed, thereby reducing the deterioration of the color toner and maintaining stable image density.

However, since correction of the monochrome toner density and of the color toner density are performed based on the number of prints or the printing time in principle, density correction may be performed even if there is no need to perform the density correction in the image forming units. Particularly, density correction that occurs during monochrome printing interrupts printing by the user although it is often not necessary to perform the density correction, that is, only a small amount of correction is often achieved by density correction in monochrome (black) printing.

SUMMARY

According to an embodiment of the present disclosure, an image forming apparatus is provided using an electrophotographic process. The apparatus includes an image forming unit, a storage unit, and a control unit. The image forming unit performs monochrome printing and color printing. The storage unit stores print ratio data that relates to the printing in the image forming unit and that is measured over time. The control unit separately performs correction of monochrome toner density and color toner density based on a predetermined first condition. If the first condition in the monochrome printing is met, the control unit performs correction of the monochrome toner density if a predetermined second condition relating to an amount of variation in the print ratio identified from the print ratio data is met.

According to another embodiment of the present disclosure, a method for performing image forming is provided using an electrophotographic process. The method includes: performing monochrome printing and color printing; storing print ratio data that relates to the printing and that is measured over time; and separately performing correction of monochrome toner density and color toner density based on a predetermined first condition. If the first condition in the monochrome printing is met, correction of the monochrome toner density is performed if a predetermined second condition relating to an amount of variation in the print ratio identified from the print ratio data is also met.

Additional features and advantages are described herein, and will be apparent from the following Detailed Description and the figures.

BRIEF DESCRIPTION OF THE FIGURES

The following detailed description, given by way of example, but not intended to limit the disclosure solely to the specific embodiments described, may be understood in conjunction with the accompanying drawings, in which.

DETAILED DESCRIPTION

Reference will now be made to embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents. Embodiments of image forming apparatus and method for performing image forming using an electrophotographic process will now be described in detail.

Embodiments of the present disclosure will herein be described with reference to the attached drawings.

Figure 1:
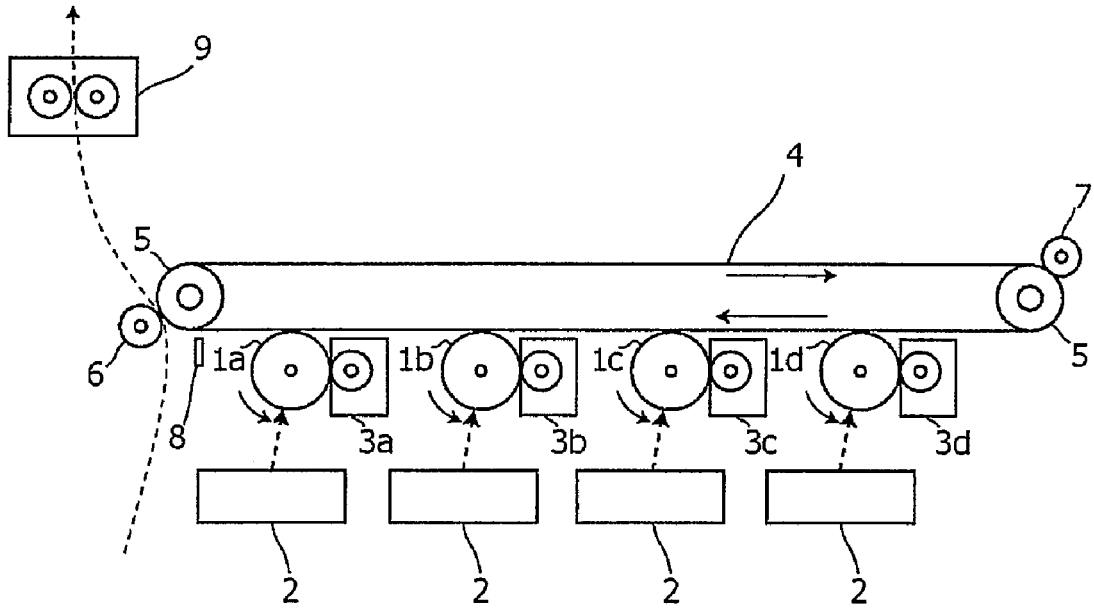
FIG. 1 is a side view showing an example of the internal mechanical structure of an image forming apparatus using an electrophotographic process according to an embodiment of the present disclosure.

FIG. 1 is a side view showing an example of the internal mechanical structure of an image forming apparatus using an electrophotographic process according to an embodiment of the present disclosure. The image forming apparatus can be, for example, a printer apparatus, a facsimile apparatus, a copier apparatus, or a multifunction peripheral having a print function.

The image forming apparatus of this embodiment includes color image forming units connected in tandem. The color image forming units are capable of performing monochrome printing and color printing and each includes at least a color developer. The color image forming units include photosensitive drums 1*a* to 1*d*, exposure devices 2, and developers 3*a* to 3*d*. The photosensitive drums 1*a* to 1*d* are photosensitive bodies for four colors: cyan, magenta, yellow, and black.

The exposure devices 2 irradiate the photosensitive drums 1*a* to 1*d* with laser light to form electrostatic latent images on the photosensitive drums 1*a* to 1*d*. Each exposure device 2 is a laser scanner unit. The exposure device 2 includes a laser diode, which is a light source of the laser light, and optical elements (a lens, a mirror, a polygon mirror, etc.) that convey the laser light from the laser diode to the photosensitive drums 1*a* to 1*d*. One exposure device 2 is provided for each color and is mounted to a structure, such as a housing, in the image forming apparatus.

The developers 3*a* to 3*d* adhere the toner, in the toner cartridge, to the electrostatic latent images on the photosensitive drums 1*a* to 1*d* to form toner images of corresponding colors.

The photosensitive drum 1*d* and the developer 3*d* develop an image of magenta, the photosensitive drum 1*c* and the developer 3*c* develop an image of cyan, the photosensitive drum 1*b* and the developer 3*b* develop an image of yellow, and the photosensitive drum 1*a* and the developer 3*a* develop an image of black.

An intermediate transfer belt 4 is an annular image carrier that is in contact with the photosensitive drums 1*a* to 1*d* from which the toner images are transferred. The intermediate transfer belt 4 is stretched around a drive roller 5 and moves around in a direction from a position where the intermediate transfer belt 4 is in contact with the photosensitive drum 1*d* to a position where the intermediate transfer belt 4 is in contact with the photosensitive drum 1*a* due to the drive force provided by the drive roller 5.

A transfer roller 6 causes a sheet of paper that is fed to contact the intermediate transfer belt 4 transferring the toner images on the intermediate transfer belt 4 onto the sheet of paper. The sheet of paper on which the toner images are transferred is fed to a fixing unit 9 where the toner images are fixed on the sheet of paper.

A roller 7 is in contact with the intermediate transfer belt 4 to remove the toner remaining on the intermediate transfer belt 4 after the toner images are transferred onto the sheet of paper.

A sensor 8 irradiates the intermediate transfer belt 4 with light to detect reflected light from the intermediate transfer belt 4. In density correction, the sensor 8 irradiates a patch image (toner image) on the intermediate transfer belt 4 with light to detect reflected light from the patch image. The toner density is calculated from the intensity of the reflected light that is detected by the sensor 8.

Figure 2:
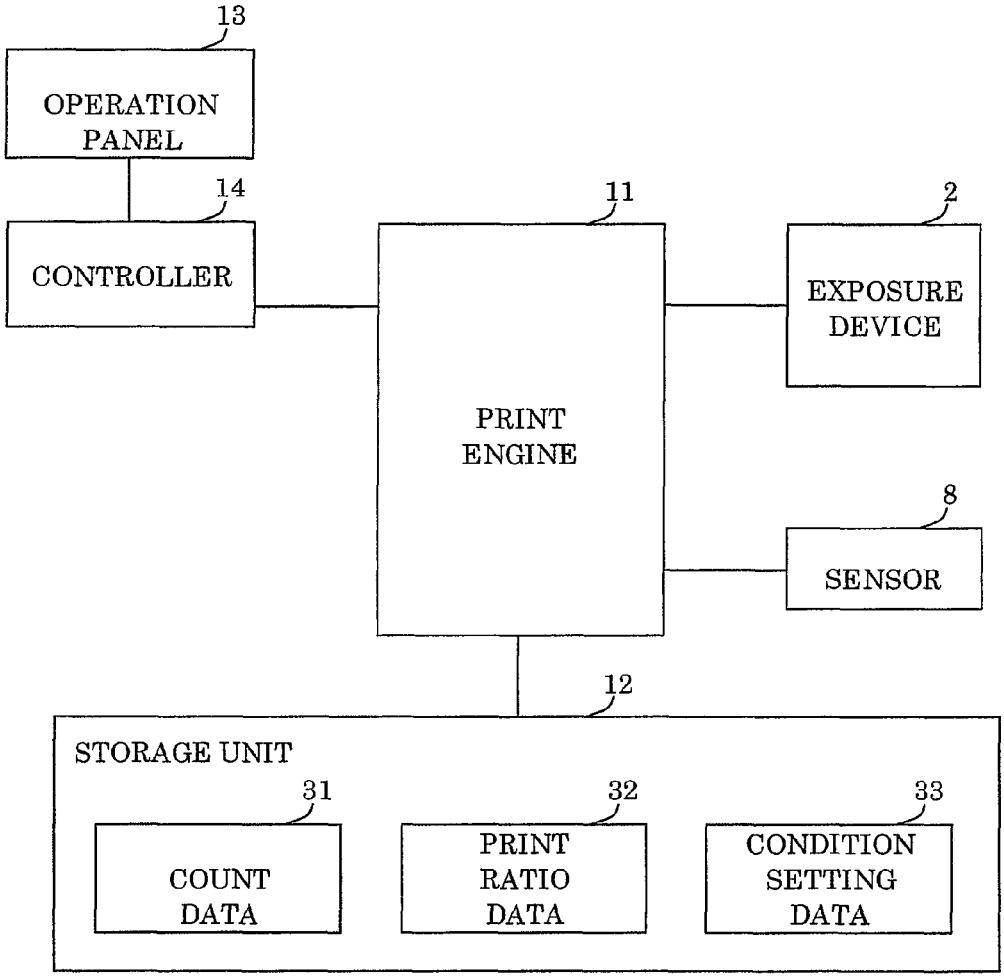
FIG. 2 is a block diagram showing an example of the functional configuration of the image forming apparatus using an electrophotographic process according to an embodiment of the present disclosure.

FIG. 2 is a block diagram showing an example of the functional configuration of the image forming apparatus according to an embodiment. Referring to FIG. 2, a print engine 11 is a processing circuit that controls a drive source (not shown) that drives the rollers and so on (described above) and the exposure devices 2 causing the drive source and the exposure devices 2 to feed paper, print, and eject the paper. The print engine 11 separately performs correction of the monochrome toner density and of the color toner density based on a predetermined first condition. Here, the first condition relates to a count value of the printing time or the number of prints. In density correction, the print engine 11 calculates the toner density of the patch image of each color from the value output from the sensor 8, which is acquired for the patch image of each color. Then, the print engine 11 adjusts the toner densities of the respective colors in the developers 3*a* to 3*d* based on the calculated value of the toner density.

A storage unit 12 includes a non-volatile storage medium (for example, a flash memory or a hard disk drive) that stores a variety of data. Here, the storage unit 12 stores count data 31, print ratio data 32, and condition setting data 33.

The count data 31 includes an integrated value of a printing time or the number of prints since the previous density correction. The count data 31 includes the integrated value in the monochrome printing and the integrated value in the color printing.

The print ratio data 32 indicates the amount of variation in the print ratio in the monochrome printing, which is measured with time by the print engine 11. The print ratio is the ratio of the printed area (covered with dots of characters and/or graphics) to the whole area in a sheet. For example, the print ratio data 32 includes a history of the print ratios of each page since the second previous correction of the monochrome toner density. Alternatively, the print ratio data 32 includes the average print ratio from the second previous correction of the monochrome toner density to the previous correction of the monochrome toner density and the average print ratio from the previous correction of the monochrome toner density to the current time. In other words, the above history or the average print ratios in the two periods indicate the amount of variation in the print ratio.

The condition setting data 33 includes, for example, a setting indicating whether the density correction is skipped. The setting is based on each threshold value (described below) and the amount of variation in the print ratio in the monochrome printing (described below).

An operation panel 13 includes a display device, such as a liquid crystal display, and an input device, such as a touch panel. A controller 14 is a circuit that receives a user's instructions and a job to control the internal components including the print engine 11 and the operation panel 13.

The print engine 11 will now be described.

If the first condition relating to the monochrome printing is met, the print engine 11 performs correction of the monochrome toner density if a predetermined second condition relating to the amount of variation in the print ratio identified from the print ratio data is also met, and does not perform the correction of the monochrome toner density if the second condition is not met.

The print engine 11 operates as a first count unit that counts the number of prints or the printing time in the monochrome printing by the integration and a second count unit that counts the number of prints or the printing time in the color printing by the integration. If a count value Cm in the monochrome printing reaches a density correction execution value A, which is the first condition, the print engine 11 performs correction of the monochrome toner density if the amount of variation D in the print ratio in the monochrome printing is not less than a first threshold value C, and does not perform correction of the monochrome toner density if the amount of variation D in the print ratio in the monochrome printing is less than the first threshold value C. In addition, the print engine 11 performs correction of the monochrome toner density and the color toner density if a count value Cc in the color printing reaches the density correction execution value A, which is the first condition. The density correction execution value A in the monochrome printing may be the same as or different from the density correction execution value A in the color printing.

Figure 3:
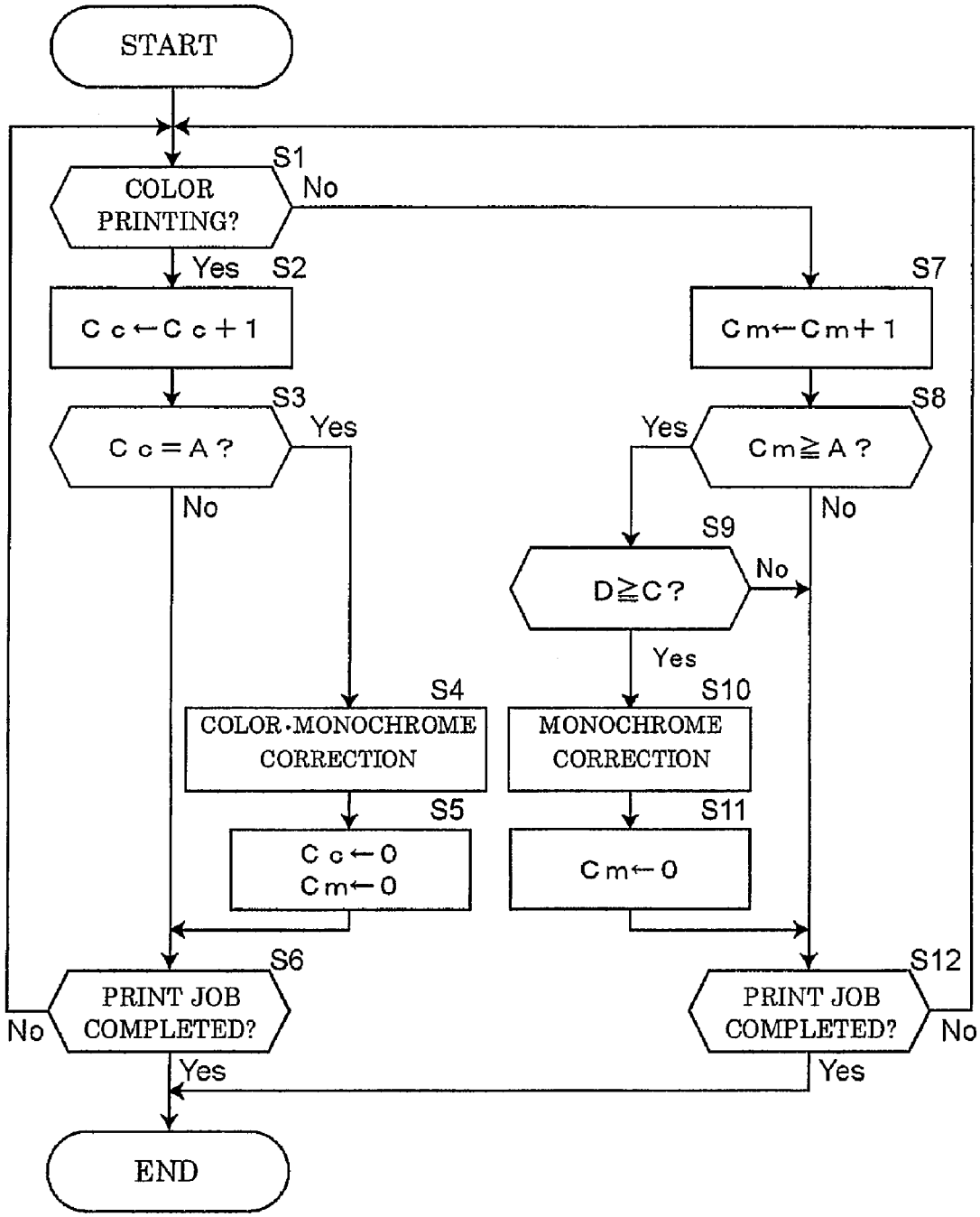
FIG. 3 is a flowchart showing an example of a density correction process in an embodiment of the present disclosure.

An example of the operation of the image forming apparatus will now be described. FIG. 3 is a flowchart showing an example of a density correction process in an embodiment.

At the beginning of a print job with a user's instructions or the like, the print engine 11 controls each of the components to start the printing. When printing starts, the print engine 11 performs the following steps to control the timing of the density correction.

Referring to FIG. 3, in Step S1, the print engine 11 determines whether a target page to be printed is a color page. If the target page is a color page, then in Step S2, the print engine 11 increases the count value Cc in the color printing by one. The count value Cc in the color printing indicates the integrated value of the number of prints in the color printing. In Step S3, the print engine 11 determines whether the count value Cc in the color printing reaches the density correction execution value A.

If the count value Cc in the color printing reaches the density correction execution value A, in Step S4, the print engine 11 performs correction of the monochrome toner density and the color toner density (the correction of the toner density of cyan, magenta, yellow, and black). After the density correction, in Step S5, the print engine 11 resets the count value Cc in the color printing and the count value Cm in the monochrome printing to zero. The print engine 11 can calculate the average print ratio from the previous correction of the monochrome toner density (including the situation where correction of the monochrome toner density is performed simultaneously with correction of the color toner density) to the current correction of the monochrome toner density and can store the calculated average print ratio in the storage unit 12 as the print ratio data 32.

If the count value Cc in the color printing does not reach the density correction execution value A in Step S3, Steps S4 and S5 are not performed.

In Step S6, the print engine 11 determines whether the print job is completed. If a subsequent target page exists, the process goes back to Step 1 to continue the steps. If the print job is completed, the process controlling the timing of the density correction is terminated.

If the print engine 11 determines in Step S1 that the target page is not a color page (that is, is a monochrome page), in Step S7, the print engine 11 increases the count value Cm in the monochrome printing by one. The count value Cm in the monochrome printing indicates the integrated value of the number of prints in the monochrome printing. In Step S8, the print engine 11 determines whether the count value Cm in the monochrome printing is not less than the density correction execution value A.

If the count value Cm in the monochrome printing is not less than the density correction execution value A, the print engine 11 identifies the amount of variation D in the print ratio in the monochrome printing based on the print ratio data 32 and, in Step S9, determines whether the amount of variation D in the print ratio in the monochrome printing is not less than the first threshold value C.

The amount of variation D in the print ratio is based on, for example, an average print ratio D1 from the second previous density correction to the previous density correction and an average print ratio D2 from the previous density correction to the time when the first condition in the monochrome printing is met (that is, to the time when the print engine 11 determined that the amount of variation D is not less than the first threshold value C in Step S9). The amount of variation D in the print ratio is the absolute value of the difference between the average print ratio D1 and the average print ratio D2($D=|D1-D2|$).

If the amount of variation D in the print ratio in the monochrome printing is not less than the first threshold value C, then in Step S10, the print engine 11 performs only correction of the monochrome toner density (only correction of the black toner density). After the density correction, in Step S11, the print engine 11 resets the count value Cm in the monochrome printing to zero. The print engine 11 may calculate the average print ratio from the previous correction of the monochrome toner density to the current correction of the monochrome toner density and may store the calculated average print ratio in the storage unit 12 as the print ratio data 32.

If the count value Cm in the monochrome printing does not reach the density correction execution value A in Step S8, Steps S9 to S11 are not performed. However, the print ratio of the target page is calculated. The calculated print ratio of the target page is maintained as, for example, the print ratio data 32.

Also if the print engine 11 determines in Step S9 that the amount of variation D in the print ratio in the monochrome printing is less than the first threshold value C, Steps S10 and S11 are not performed. In other words, although density correction should be performed based on the condition of the count value Cm in the monochrome printing, correction of the monochrome toner density is skipped because the amount of variation D in the print ratio is small. In addition, in this embodiment, correction of the monochrome toner density is continually skipped if the amount of variation D in the print ratio is not further increased.

In Step S12, the print engine 11 determines whether the print job is completed. If a subsequent target page exists, the process goes back to Steps 1 to continue the steps. If the print job is completed, the process controlling the timing of the density correction is terminated.

As described above, the image forming apparatus according to this embodiment includes the image forming unit that comprises at least photosensitive drums 1*a* to 1*d*, exposure devices 2, and developers 3*a* to 3*d* and that is capable of performing monochrome printing and color printing. The image forming apparatus also includes the storage unit 12 that stores print ratio data 32 that relates to printing with the image forming unit and that is measured over time, and the print engine 11 separately performing correction of the monochrome toner density and correction of the color toner density based on the predetermined first condition. If the first condition concerning the monochrome printing is met, the print engine 11 performs correction of the monochrome toner density if the predetermined second condition relating to the amount of variation in the print ratio, identified from the print ratio data, is met and does not perform correction of the monochrome toner density if the second condition is not met.

If the print ratio varies in the image forming apparatus, the density may change because the state of the electrostatic charge of the toner is changed in accordance with variation in the print ratio. Accordingly, since the amount of change in the density is considered to be small if the amount of variation in the print ratio is small, correction of the monochrome toner density is not performed. This allows correction of the monochrome toner density and correction of the color toner density to be appropriately performed. Specifically, it is possible to reduce the number of times when unnecessary correction of the monochrome toner density is performed, to suppress deterioration of the toner, and to not decrease print speed because of unnecessary interruptions caused by the density correction.

In another embodiment of the present disclosure, correction of the monochrome toner density and the color toner density are simultaneously performed if it is estimated that there will be a short time before the first condition concerning the color printing is met at the time of correction of the monochrome toner density.

The basic structure and the operation of an image forming apparatus according to this embodiment is the same as the previous embodiment. However, the print engine 11 in this embodiment operates in the following manner.

Figure 4:
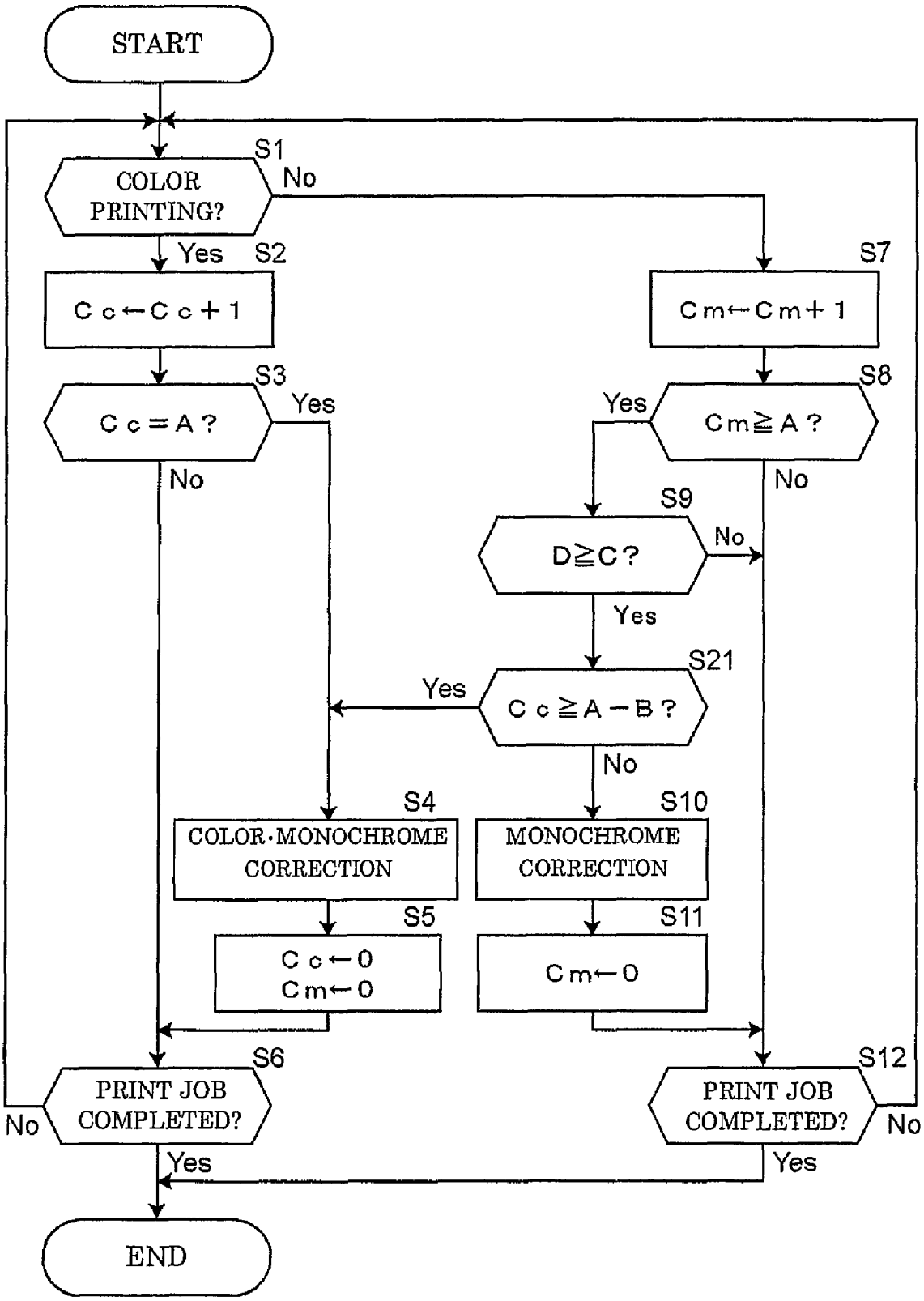
FIG. 4 is a flowchart showing an example of a density correction process in another embodiment of the present disclosure.

FIG. 4 is a flowchart showing an example of a density correction process in this embodiment. The flowchart in FIG. 4 includes Step S21 between Step S9 and Step S10 in FIG. 3. The same reference numerals are used in FIG. 4 to identify the same steps in FIG. 3.

According to this embodiment, before correction of the monochrome toner density (Step S10), in Step S21, the print engine 11 determines whether the count value Cc in the color printing is not less than a predetermined second threshold value (A−B, B>0) less than the density correction execution value A. For example, the difference B between the density correction execution value A and the second threshold value is around 0.2 by A to 0.05 by A (for example, 0.1 by A).

If the count value Cc in the color printing is not less than the predetermined second threshold value (A−B), in Step S4, the print engine 11 performs correction of the monochrome toner density and of the color toner density.

If the count value Cc in the color printing is less than the predetermined second threshold value (A−B), in Step S10, the print engine 11 performs correction of the monochrome toner density.

As described above, according to this embodiment, if the count value Cm in the monochrome printing is not less than (in other words, reaches) the density correction execution value A, the print engine 11 performs correction of the monochrome toner density and correction of the color toner density if the count value Cc in the color printing is not less than the predetermined second threshold value (A−B) less than the density correction execution value A.

Accordingly, since correction of the monochrome toner density and the color toner density are simultaneously performed, if it is estimated that it will be a short time before the first condition concerning the color printing is met (Step S3), at the time of correction of the monochrome toner density, it is possible to prevent correction of the monochrome toner density from being repeated for a short time.

In a still further embodiment of the present disclosure, correction of the monochrome toner density is performed periodically for a relatively long period even if the amount of variation in the print ratio is continually small.

The basic structure and the operation of an image forming apparatus according to this embodiment is the same as the ones in the previous embodiment. However, the print engine 11 in this embodiment operates in the following manner.

Figure 5:
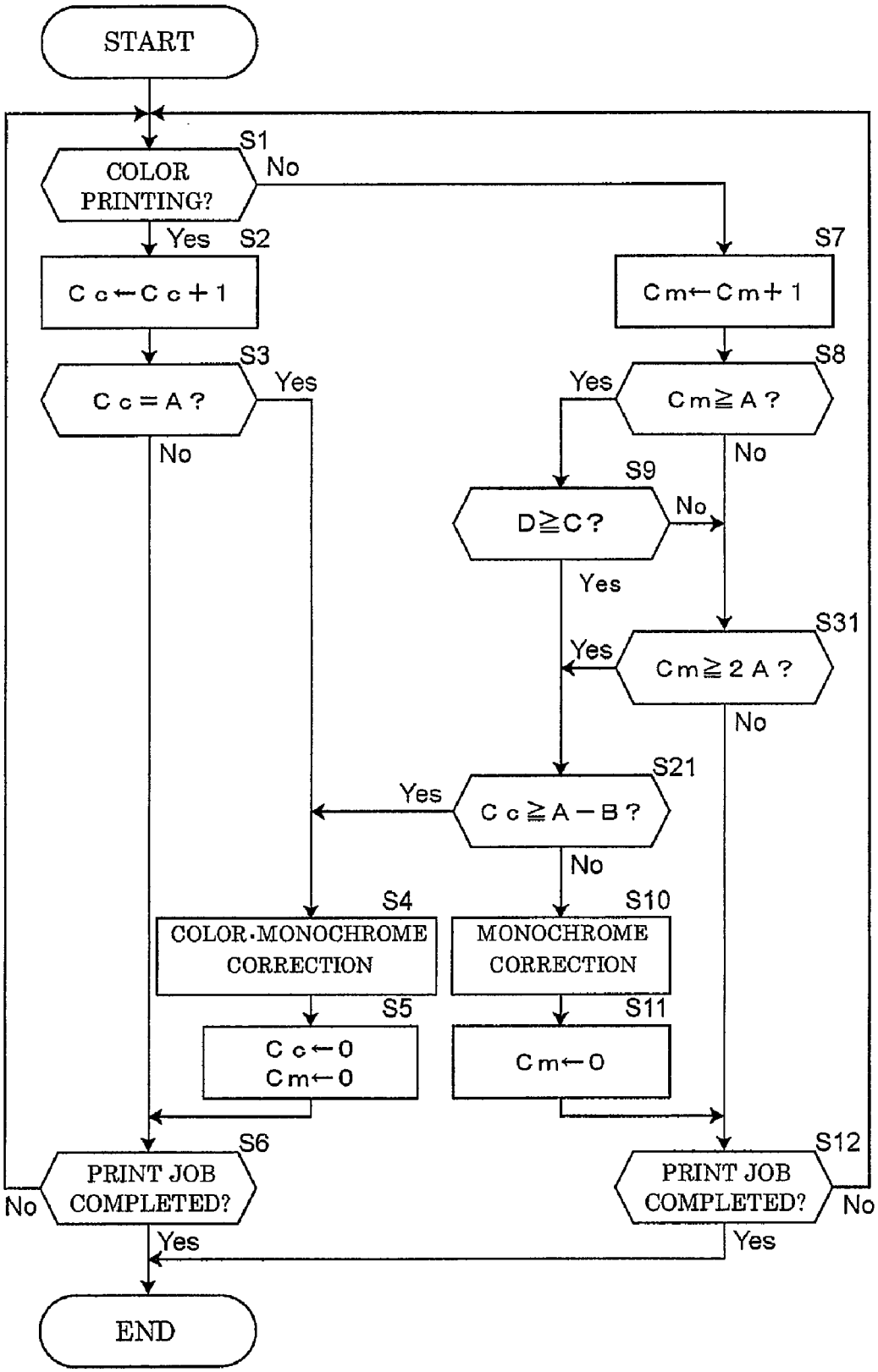
FIG. 5 is a flowchart showing an example of a density correction process in a further embodiment of the present disclosure.

FIG. 5 is a flowchart showing an example of a density correction process in this embodiment. The flowchart in FIG. 5 includes the addition of Step S31 between Steps S8 and S9 and Step S12 in FIG. 4. The same reference numerals are used in FIG. 5 to identify the same steps in FIG. 4.

According to this embodiment, after the print engine 11 determines in Step S9 that the amount of variation D in the print ratio is less than the first threshold value C, in Step S31, the print engine 11 determines whether the count value Cm in the monochrome printing reaches a predetermined third threshold value (twice the density correction execution value A in the monochrome printing in this example) greater than the density correction execution value A.

If the count value Cm in the monochrome printing is not less than (in other words, reaches) the third threshold value, the print engine 11 performs correction of the monochrome toner density (Step S10 or Step S4) regardless of the amount of variation D in the print ratio in the monochrome printing.

If the count value Cm in the monochrome printing is less than (in other words, does not reach) the third threshold value, the print engine 11 skips correction of the monochrome toner density.

As described above, according to this embodiment, if the count value Cm in the monochrome printing reaches the third threshold value more than the density correction execution value A, the print engine 11 performs correction of the monochrome toner density regardless of the amount of variation in the print ratio in the monochrome printing.

Accordingly, correction of the monochrome toner density is performed periodically for a relatively long period even if the amount of variation in the print ratio is continually small. Since the change in the density may also occur in situations other than the situation where the print ratio is varied, the above processing can be performed to appropriately perform density correction without leaving the change in the density that is caused by a factor other than the variation in the print ratio.

While embodiments of the invention have been described using specific terms, this description is for illustrative purposes only and it is to be understood that changes and variations may be made without departing from the spirit or scope of the following claims.

For example, although Step S31 is added to the process in the second described embodiment to the last described embodiment, Step S31 may be added to the process of the first described embodiment.

Although the third threshold value is set to a value twice that of the density correction execution value A in the monochrome printing in the last described embodiment, the third threshold value may be set to any value that is greater than twice of the density correction execution value A in the monochrome printing and not necessarily triple the value. Alternatively, the third threshold value may be based on another factor causing a change in the density.

The amount of variation D in the print ratio may be calculated using another method in the embodiments described above. For example, the average print ratio in a certain number of prints or a certain printing time in which the density correction is performed may be calculated, and the amount of variation D in the print ratio may be calculated from the average print ratio D1 for the previous density correction and the average print ratio D2 at the time when the print engine 11 determined that the amount of variation D is not less than the first threshold value C in Step S9.

The condition setting data 33 can be inputted by, for example, the user using the operation panel 13 in the embodiments described above. The controller 14 stores the input value in the storage unit 12 as the condition setting data 33. If the setting indicating whether density correction based on the amount of variation D in the print ratio in the monochrome printing is skipped has a value indicating that density correction based on the amount of variation D in the print ratio in the monochrome printing is skipped in the condition setting data 33, the density correction based on the amount of variation D in the print ratio in the monochrome printing is skipped in Step S9. In contrast, if the setting indicating whether density correction based on the amount of variation D in the print ratio in the monochrome printing is skipped has a value indicating that density correction based on the amount of variation D in the print ratio in the monochrome printing is not skipped in the condition setting data 33, Step S9 is not performed. Consequently, the user, can set whether the correction of the monochrome toner density based on the amount of variation D in the print ratio is skipped, by setting the value of the condition setting data 33. For example, if the user gives priority to print quality image over printing speed, the condition setting data 33 is set using the operation panel 13 so that Step S9 is not performed.

Although the amount of variation D in the print ratio is calculated as the difference between the average print ratios in two periods in the first to third embodiments described above, the amount of variation D in the print ratio may be calculated as the ratio of the average print ratios in two periods and the second condition may be set to a condition wherein the amount of variation D in the print ratio is outside a certain range including one.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus using an electrophotographic process comprising:

an image forming unit configured to perform monochrome printing and color printing;

a storage unit that stores print ratio data relating to printing in the image forming unit measured over time; and a control unit configured to separately perform correction of monochrome toner density and correction of color toner density based on a predetermined first condition, if the first condition in the monochrome printing is met, the control unit performs correction of the monochrome toner density if a predetermined second condition relating to an amount of variation in the print ratio identified from the print ratio data is met.

2. The image forming apparatus using an electrophotographic process according to claim 1 comprising:

a first count unit that counts the number of prints or a printing time in the monochrome printing by integration;

a second count unit that counts the number of prints or a printing time in the color printing by integration; and if the count value counted by the first count unit reaches a first density correction execution value, which is the first condition, the control unit performs correction of the monochrome toner density if the amount of variation in the print ratio in the monochrome printing is not less than a predetermined first threshold value, which is the second condition, and performs correction of the monochrome toner density and the color toner density if the count value counted by the second count unit reaches a second density correction execution value, which is the first condition.

3. The image forming apparatus using an electrophotographic process according to claim 2, wherein, if the count value counted by the first count unit reaches the first density correction execution value, the control unit performs correction of the monochrome toner density and the color toner density if the amount of variation in the print ratio in the monochrome printing is not less than the first threshold value and the count value counted by the second count unit is not less than a predetermined second threshold value less than the second density correction execution value.

4. The image forming apparatus using an electrophotographic process according to claim 2, wherein the control unit performs correction of the monochrome toner density if the count value counted by the first count unit reaches a predetermined third threshold value greater than the first density correction execution value.

5. The image forming apparatus using an electrophotographic process according to claim 1, wherein the amount of variation in the print ratio is calculated based on an average print ratio from the second previous density correction to the previous density correction and an average print ratio from the previous density correction to the time when the first condition concerning the monochrome printing is met.

6. The image forming apparatus using an electrophotographic process according to claim 1, wherein the storage unit is designed to store condition setting data and if the condition setting data has a certain value, the control unit performs correction of the monochrome toner density regardless of the second condition if the first condition concerning the monochrome printing is met.

7. The image forming apparatus using an electrophotographic process according to claim 1, wherein the amount of variation in the print ratio is calculated as a difference between average print ratios.

8. The image forming apparatus using an electrophotographic process according to claim 1, wherein the amount of variation in the print ratio is calculated as a ratio between average print ratios.

9. A method for performing image forming using an electrophotographic process comprising:

performing monochrome printing and color printing;

storing print ratio data relating to printing, measured over time; and separately performing correction of monochrome toner density and color toner density based on the use of a predetermined first condition, if the first condition in the monochrome printing is met and if a predetermined second condition concerning an amount of variation in the print ratio identified from the print ratio data is met, correction of the monochrome toner density is performed.

10. The method according to claim 9, comprising:

counting the number of prints or a printing time in the monochrome printing by integration;

counting the number of prints or a printing time in the color printing by integration; and if the count value in the monochrome printing reaches a first density correction execution value, which is the first condition, correction of the monochrome toner density is performed if the amount of variation in the print ratio in the monochrome printing is not less than a predetermined first threshold value, which is the second condition, and performs correction of the monochrome toner density and the color toner density if the count value in the color printing reaches a second density correction execution value, which is the first condition.

11. The method according to claim 10, wherein, if the count value in the monochrome printing reaches the first density correction execution value, correction of the monochrome toner density and the color toner density is performed if the amount of variation in the print ratio in the monochrome printing is not less than the first threshold value and the count value in the color printing is not less than a predetermined second threshold value less than the second density correction execution value.

12. The method according to claim 10, wherein the correction of the monochrome toner density is performed if the count value in the monochrome printing reaches a predetermined third threshold value more than the first density correction execution value.

* * * * *